US009360267B1

(12) United States Patent
Horn

(10) Patent No.: US 9,360,267 B1
(45) Date of Patent: Jun. 7, 2016

(54) ARCHERY BOW STRING DRAW BOARD

(71) Applicant: Specialty Archery, LLC, Spencer, IA (US)

(72) Inventor: Charles Edward Horn, Cedar Rapids, IA (US)

(73) Assignee: Specialty Archery, LLC, Spencer, IA (US)

( * ) Notice: Subject to any disclaimer, the term of this patent is extended or adjusted under 35 U.S.C. 154(b) by 0 days.

(21) Appl. No.: 14/573,676

(22) Filed: Dec. 17, 2014

(51) Int. Cl.
*F41B 5/14* (2006.01)
*F41B 5/10* (2006.01)

(52) U.S. Cl.
CPC ..... *F41B 5/1449* (2013.01); *F41B 5/10* (2013.01)

(58) Field of Classification Search
CPC ..... F41B 5/1449
See application file for complete search history.

(56) References Cited

U.S. PATENT DOCUMENTS 5,222,473 A * 6/1993 Lint ..... F41B 5/1449 124/1
5,370,103 A * 12/1994 Desselle ..... F41B 5/1449 124/23.1
5,433,186 A * 7/1995 Corwin ..... F41B 5/1449 124/1
6,220,235 B1 * 4/2001 Sands ..... F41B 5/1449 124/1
7,255,099 B2 * 8/2007 Henry ..... F41B 5/1449 124/1
8,387,600 B1 3/2013 Horn
8,505,523 B1 8/2013 Horn

* cited by examiner

*Primary Examiner* — John Ricci
(74) *Attorney, Agent, or Firm* — Gerald E. Helget; Briggs and Morgan, P.A.

(57) ABSTRACT

An archery bow draw board for an anchored compound archery bow having a riser, limbs, at least one cam with a pulley, or two cams, a bow string with a cable. The draw board is connectable to the bow string and includes a base plate supporting a gallows vertical pole and a gear box and side plate fixed therebelow. A worm drive on a shaft is mounted within the gear box and is turnable by an outwardly extending crank handle. An axel with a fixed reel and worm gear extends from the side plate into the gear housing wherein the worm gear meshes with the worm drive to drive the reel in either direction by turning the crank. The worm drive and worm gear hold the reel in place upon releasing the crank. A gallows horizontal extension is located on top of the gallows pole with a first pulley, and a second pulley in line with and spaced from the first pulley away from the gallows pole. A cord is wrapped around the reel and extending upwardly along the pole to the horizontal extension and over the pulleys and then downwardly adapted to hook onto and pull the draw string. Numeric indicia is fixed on the gallows pole and a bow draw length marker coordinated on the cord indicates draw length of bow string pulled by the draw board. A scale maybe placed between the cord and the bow string to indicate actual draw poundage as the bow string is pulled.

13 Claims, 7 Drawing Sheets

13
14
15
16
17
238
239
245
244
248
252
200
254
256
9
7
110
108
6
5
3
4
10
88
28
26
30
96
118
58
80
64
216
226
115
1,2
56
78
202
50

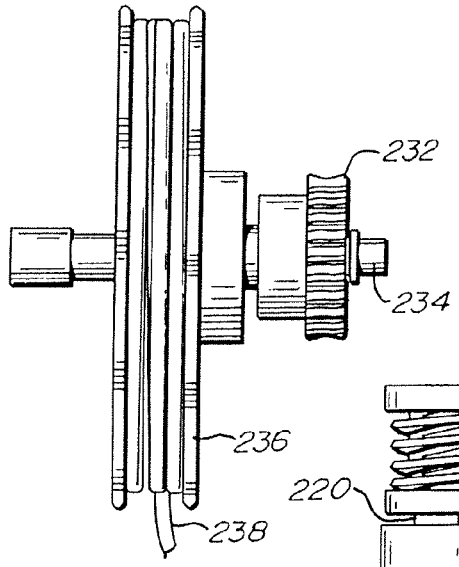
Fig. 6
Fig. 7
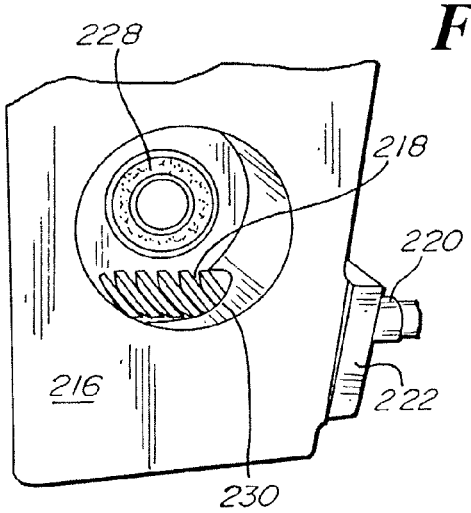
Fig. 8
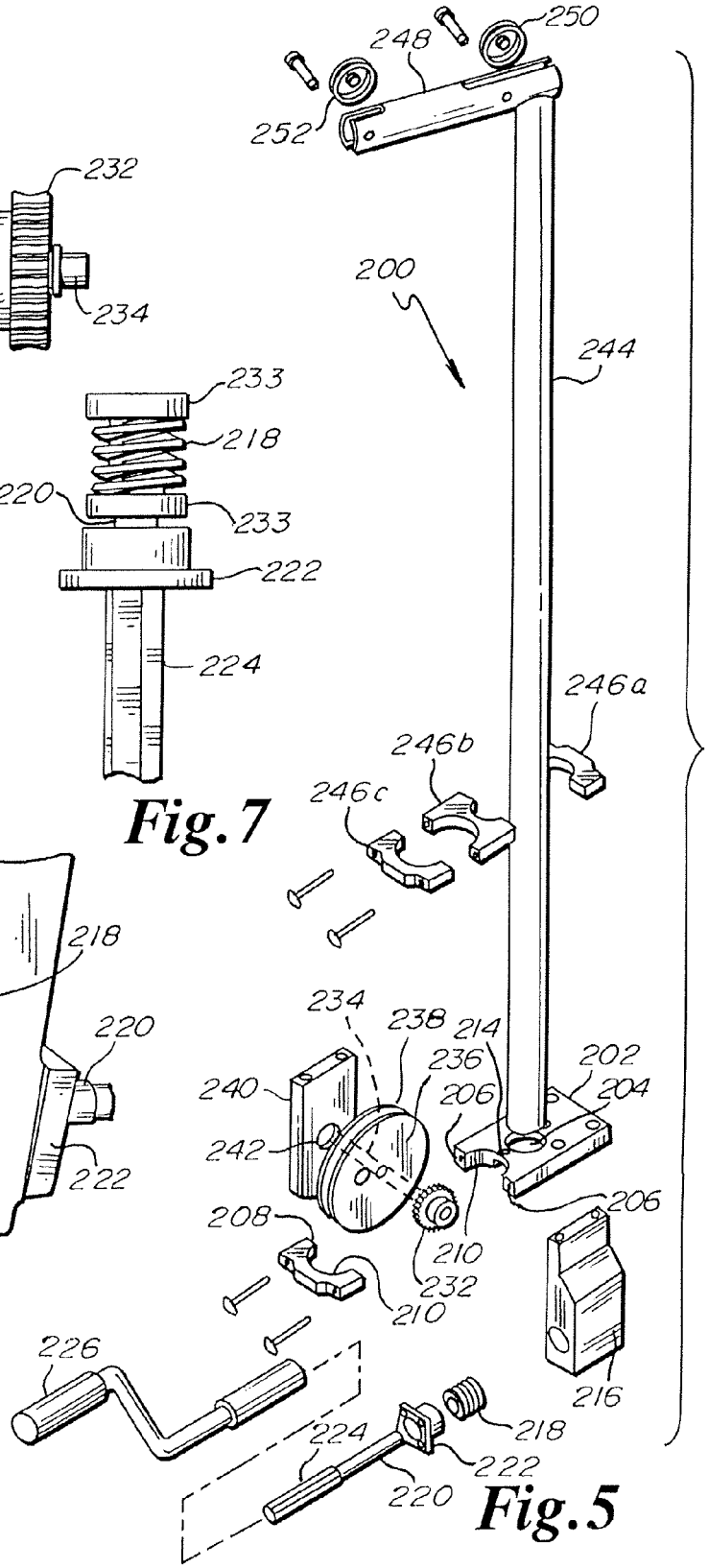
Fig. 5

| Draw length | Draw Wt |
|---|---|
| 9 | 7.6 |
| 10 | 8.4 |
| 11 | 17 |
| 12 | 26 |
| 13 | 36.2 |
| 14 | 44.4 |
| 15 | 50.8 |
| 16 | 53.8 |
| 17 | 54.2 |
| 18 | 54.4 |
| 19 | 54.4 |
| 20 | 54.4 |
| 21 | 53.8 |
| 22 | 52.4 |
| 23 | 50.2 |
| 24 | 47 |
| 25 | 42.4 |
| 26 | 35.8 |
| 27 | 26 |
| 28 | 14.8 |
| 29 | |
| 30 | |
| 31 | |
| 32 | |
| 33 | |
| 34 | |
| 35 | |

ARCHERY BOW STRING DRAW BOARD

BACKGROUND OF THE INVENTION

The present invention relates to compound archery bows, and more particularly, to an archery bow draw board for pulling on the bow string to measure draw weight and for tuning, maintenance and repair of a compound bow.

Referring to prior art FIG. 1, a typical compound archery bow 1 includes a centrally located riser 2 that has generally outwardly extending limbs 3. At the ends of the limbs are located symmetrically related pulley 4 and eccentric cam 5. Some compound bows 1 have the pulley 4 replaced with a second matching cam 5. Cable 6 of a bow string 7 is anchored and wrapped around the pulley 4 and cam 5. The other cable 6 ends have located thereon bow string 7. Optionally, the central region of the bow string 7 and the end portions of the cabling 6 are wrapped with serving thread 8 to prevent wear of these areas. A release loop 9 may be mounted in the middle of the bow string 7 for attachment of a hand release to shoot the bow 1.

Archery bows 1 require tuning, repair and maintenance for continuous accurate shooting. The appropriate draw length of the bow 1 must be set up for the archer. The cables must come off the respective pulley 4 and cam 5 in equally tuned fashion so that the shooting forces that come off the limbs 3 are even between both limbs 3. Occasionally, the serving 8 must be replaced after significant wear, or if unraveling occurs. Bow strings 7 and cabling 6 also stretch over time requiring re-anchoring to the pulley 4 and cam 5 or total replacement. Sometimes it is desired to twist the bow string 7 for proper alignment of the hardware mounted thereon, like a peep sight.

In the past, a common method of checking the actual draw weight or poundage to pull the bow string 7 back to the shooting position required an upper solid structure, like a beam A, to which is mounted a spring scale B in a swivel fashion. The archery shop technician would hook the bow string 7 onto the scale B and with his hands C pull the bow downwardly while observing the output of the scale B. A hand-held scales are also available. While this method has worked well, no tuning, maintenance, repair or adjustment can be made by the technician during this measurement effort.

A bow press 10 is a necessary tool for all archery shops and advanced archers who tune and maintain their own bows 1. Co-owned U.S. Pat. Nos. 8,387,600 and 8,505,523 illustrate the construction and operation of a bow press 10 which are incorporated herein by reference. In simple terms, a bow press 10 is shown in FIG. 2. Bow press 10 has an elongate main beam 26 which support first and second pivot arms 28, 30 supported from below by laterally adjustable pivot arm brackets 56, 58 at least partially mounted on threaded adjustment rod 64 which is rotatable by crank 118. Rotation of crank 118 moves the pivot arm brackets inwardly or outwardly for proper fitting of the particular bow 1 on the bow press 10. Above the brackets 56, 58 are located inside surface supports 78, 80 for locking the bow 1 onto the bow press 10 for service and adjustments. Limb deflectors or ears 88, 96 are adjustably mounted on pivot arms 28, 30 and are capable of pressing and holding against the limbs 3. An upstanding screw jack 50, with an extendable portion 113, is adjusted upwardly or downwardly by a crank 115. Links 108, 110 connect the pivot arms 28, 30 to the extendable portion 113 of the screw jack 50 as to move the limb ears 88, 96 inwardly and outwardly to facilitate cable 6 and bow string 7 relaxation for performing tuning, repair and maintenance functions.

SUMMARY OF THE INVENTION

An archery bow draw board for an anchored compound archery bow having a riser, limbs, at least one cam with a pulley, or two cams, a bow string with a cable. The draw board is connectable to the bow string and includes a base plate supporting a gallows vertical pole and a gear box and side plate fixed therebelow. A worm drive on a shaft is mounted within the gear box and is turnable by an outwardly extending crank handle. An axel with a fixed reel and worm gear extends from the side plate into the gear housing wherein the worm gear meshes with the worm drive to drive the reel in either direction by turning the crank. The worm drive and worm gear hold the reel in place upon releasing the crank. A gallows horizontal extension is located on top of the gallows pole with a first pulley, and a second pulley in line with and spaced from the first pulley away from the gallows pole. A cord is wrapped around the reel and extending upwardly along the pole to the horizontal extension and over the pulleys and then downwardly adapted to hook onto and pull the draw string. Numeric indicia is fixed on the gallows pole and a bow draw length marker coordinated on the cord indicates draw length of bow string pulled by the draw board. A scale maybe placed between the cord and the bow string to indicate actual draw poundage as the bow string is pulled.

A principle object and advantage of the invention is that the draw board allows the bow string to be easily drawn with the simple rotation of the crank and the position of the string is maintained when the crank is released.

Another object and advantage of the invention is that the draw board may be utilized with a scale to track the actual poundage as the bow string is pulled back through its power curve to full draw length while recording both the poundage and the draw length numeric indicia on the gallows pole that corresponds to the bow draw length marker on the cord.

Another object and advantage of the invention is that the draw board works well in conjunction with a bow press to pull the string of the anchored bow to any position afterwhich the limb ears are positioned to hold the bow limbs and the draw board is backed down to allow the archery technician to perform tuning, draw length adjustments, repair and maintenance on the archer bow.

BRIEF DESCRIPTION OF THE DRAWINGS

FIG. 5 is an exploded perspective view of the draw board of the present invention;

FIG. 6 is a front elevational view of the axel, reel and worm gear;

FIG. 7 is a front elevational view of the shaft and worm drive;

FIG. 8 is an inside view of the gear box showing the worm drive;

FIG. 13 is a front elevational view of the draw board attached to a bow press with an anchored bow with the bow string released from the draw board for repair, tuning or maintenance; and.

DETAILED SPECIFICATION

Figure 1:
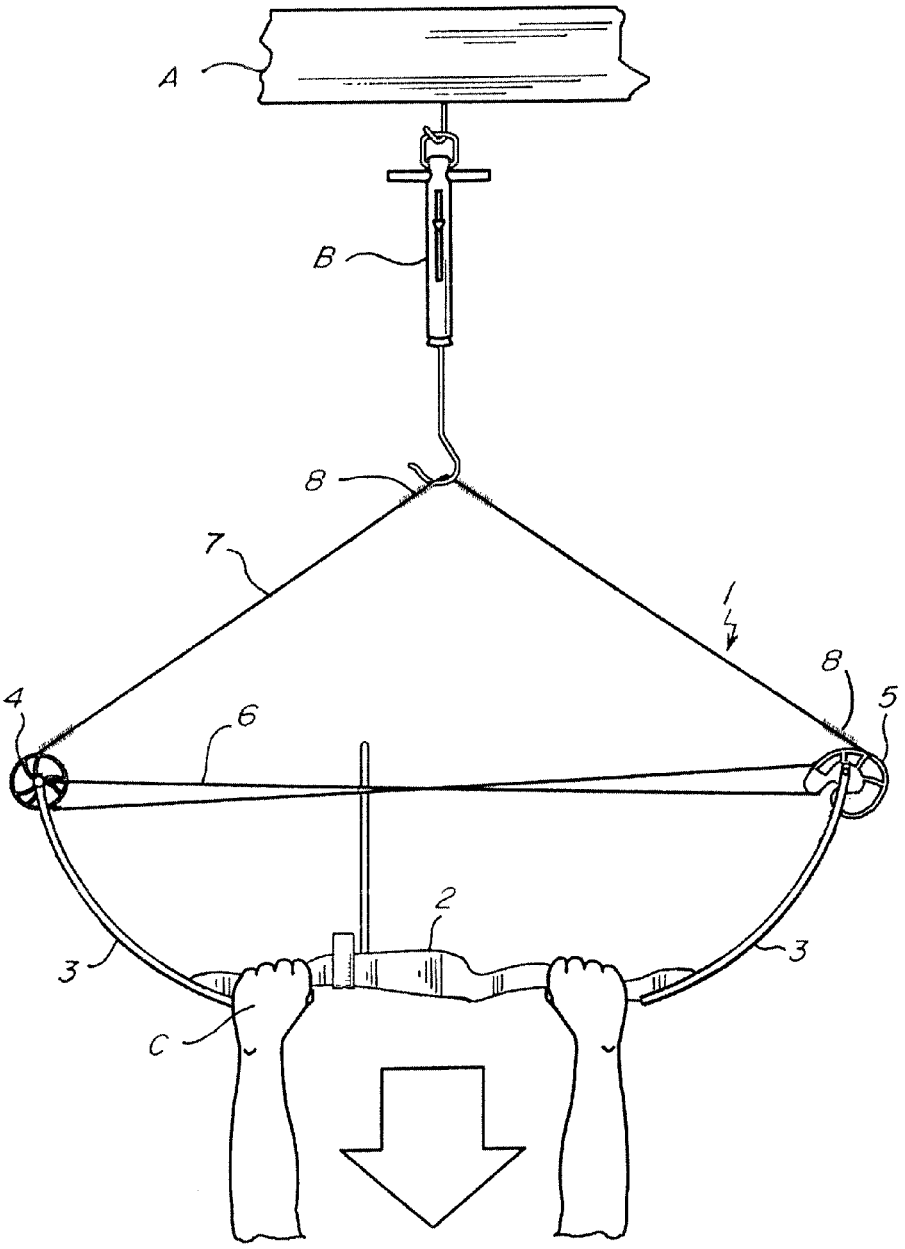
Fig.1 (PRIOR ART)
FIG. 1 is a front elevational view partially broken away showing a prior art method of measuring bow draw poundage.
Figures 2, 3, 4:
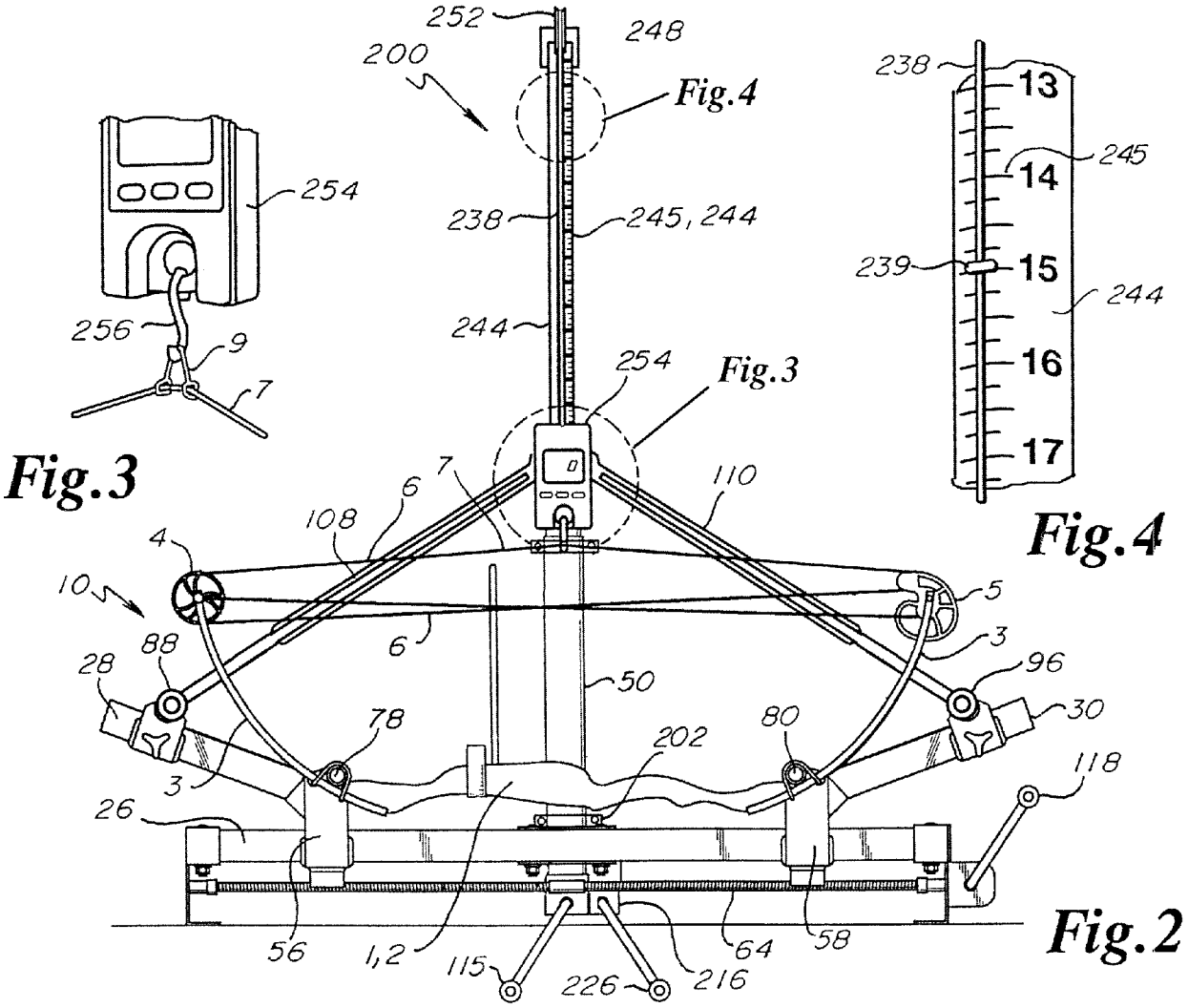
FIG. 2 is a front elevational view showing a compound bow anchored to a prior art bow press and connected to the archery bow draw board therebehind.
FIG. 3 is an enlarged front elevational view of the scale taken from the phantom circled of FIG. 2.
FIG. 4 is an enlarged front elevational view of the gallows pole of the draw board taken from the phantom circled of FIG. 2.
Figure 9:
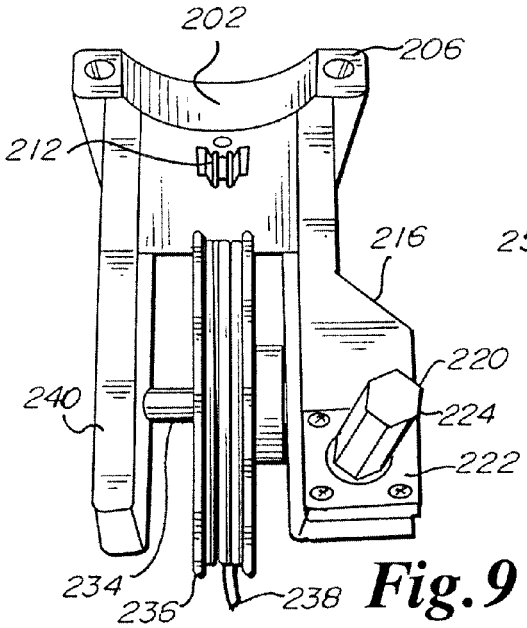
FIG. 9 is a front lower elevational view of the assembled gear box and cord pulley.
Figure 11:
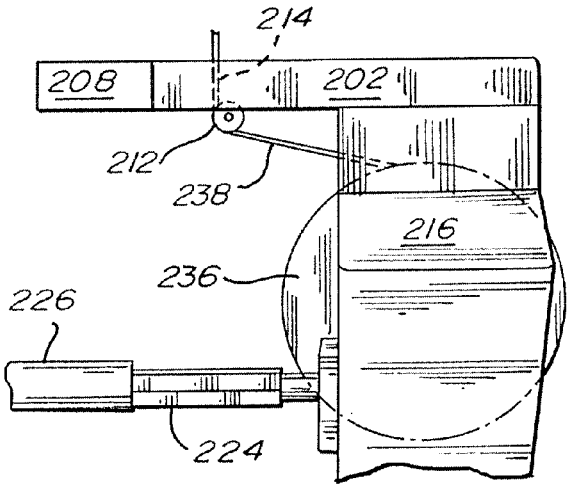
FIG. 11 is a broken away side elevational view of the assembled gear box.
Figure 10:
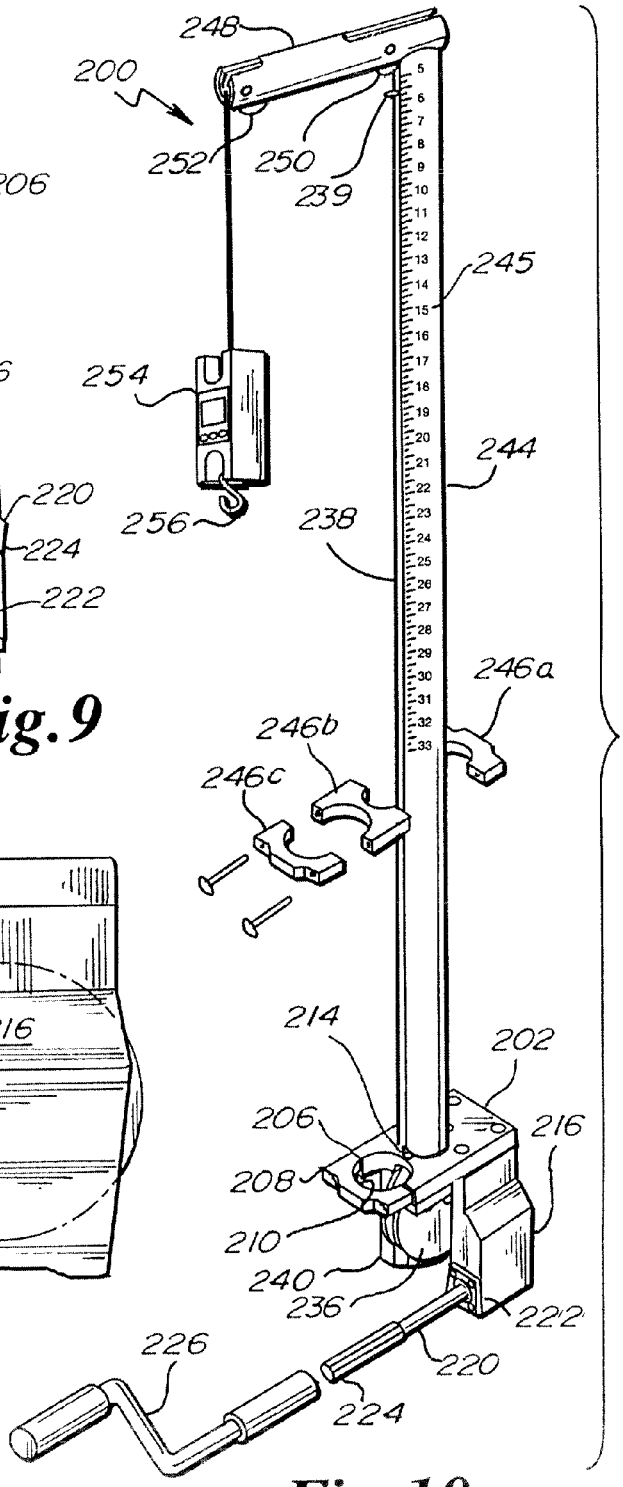
FIG. 10 is an assembled perspective view of the assembled drawing board.
Figure 12:
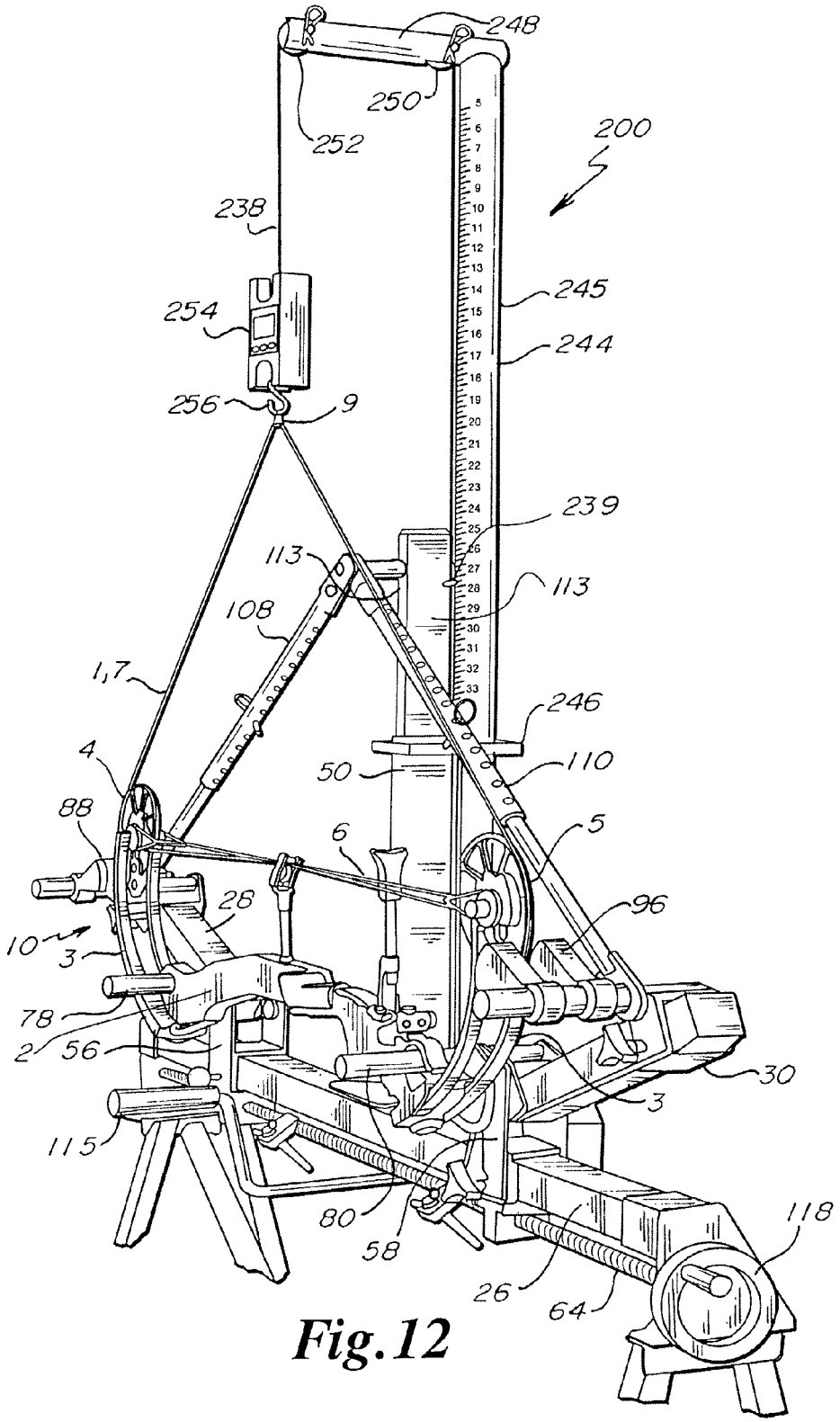
FIG. 12 is a side perspective view of the draw board attached to a bow press with an anchored bow pulling on bow string.
Figure 13:
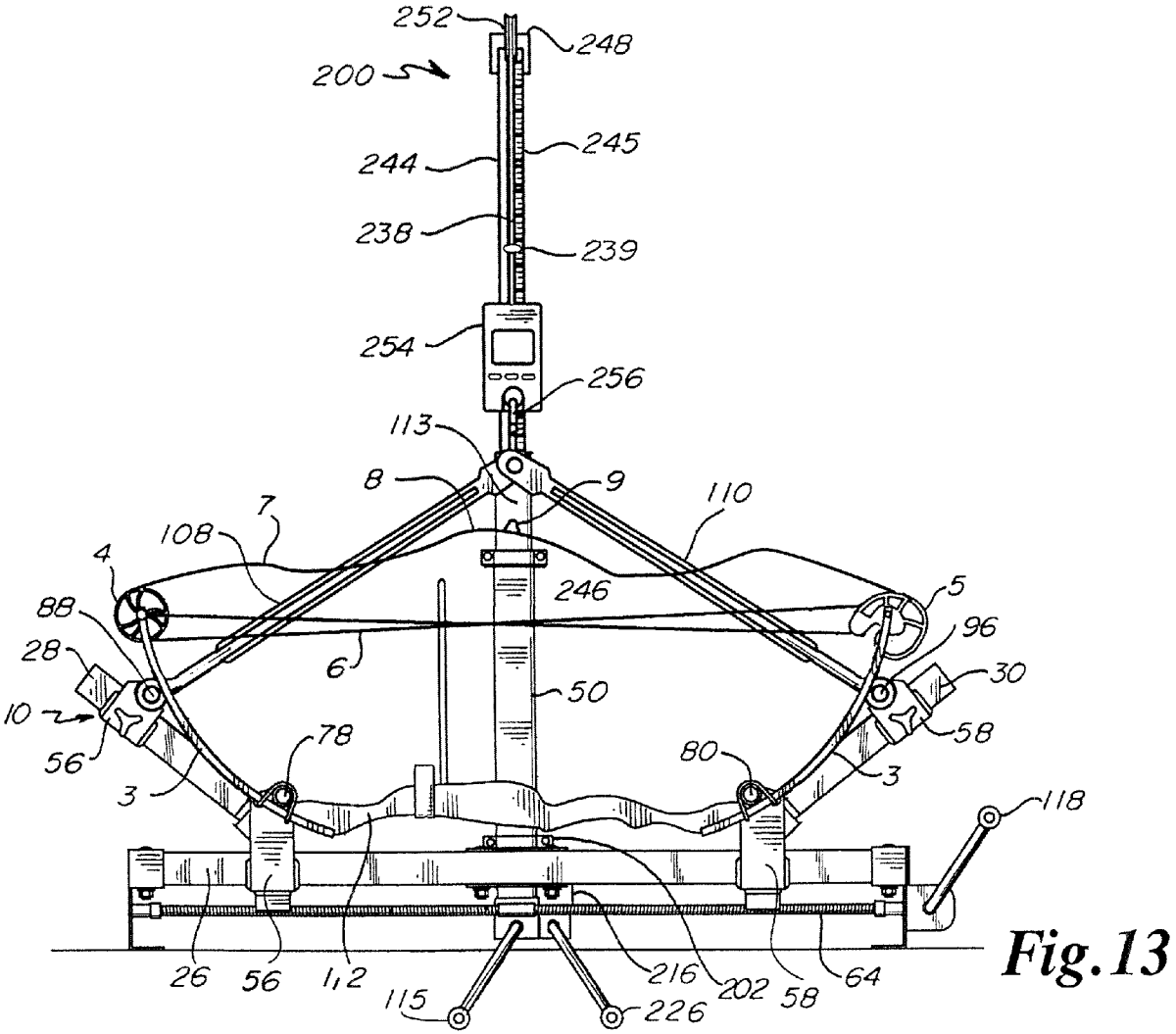

Referring to FIGS. 2 through 10, the parts, assembly and workings of the archery bow draw board 200 of the present invention may be appreciated. The draw board has a base plate 202 which has a pole recess 204 and ears 206. A bracket 208 with similar ears create an aperture 210 for fastening the draw board 200 to the bow press screw jack 50. The draw board could otherwise be anchored to a similar device that only includes a main beam 26 and inside surface supports 78, 80 for anchoring a bow thereto. The underside of the base plate 202 has a pulley arrangement 212 for guiding the draw board cord 238 through a cord aperture 214 vertically through plate 202.

A gear box 216 is mounted to and below the base plate 202 suitably by machine screws or the like. The gear box 216 supports a worm drive 218 mounted or keyed onto an outwardly extending shaft 220. Bearings 233 keep the worm drive in place along with plate 222 secured to the gear box 216. Shaft 220 is splined or otherwise configured to accept crank 226 with a matching coupling. The assembled arrangement clearly may be seen in worm drive cut out 230 inside the gear box 216 in FIG. 8 along with the bearing seat 228 for the worm gear assembly 232. Worm gear 232 is keyed onto reel axel 234 which also supports a keyed reel 236. A non-stretching, suitably braded cord 238 is wound onto reel 236. The cord of which passes over pulley 212 and upwardly through base plate aperture 214. The ends of the reel axel fit into bearing 242 in side plate 240 and bearing seat 228 inside the gear box 216. Side plate 240 is similarly mounted to and below the base plate completing the assembly of the base plate 202, side plate 240 and gear box 216.

Base plate 202 has the vertical gallows pole 244 securely mounted into its pole recess 204. Measuring indicia or scaled numbers 245 in reverse order are marked along the pole 244 with higher numbers and measurements nearer the bottom of pole 244 and lower numbers and measurements nearer the top of the pole 244. Partially up pole 244 is another set of eared brackets 246 *a, b*, and *c* which further secure the draw board 200 to the screw jack 50 of the bow press 10. At the top of gallows pole 244 is a horizontal extension extending outwardly over the bow press with first and second pulleys 250 and 252. The cord 238 passing through plate aperture 214 passes over first and second pulleys 250 and 252 and downwardly over the anchored archery bow 1 and bow press 10. At the end of cord 238 is suitably secured a scale 254 supporting a hook 256 to capture the bow string 7, serving 8 or release loop 9.

Figure 14:
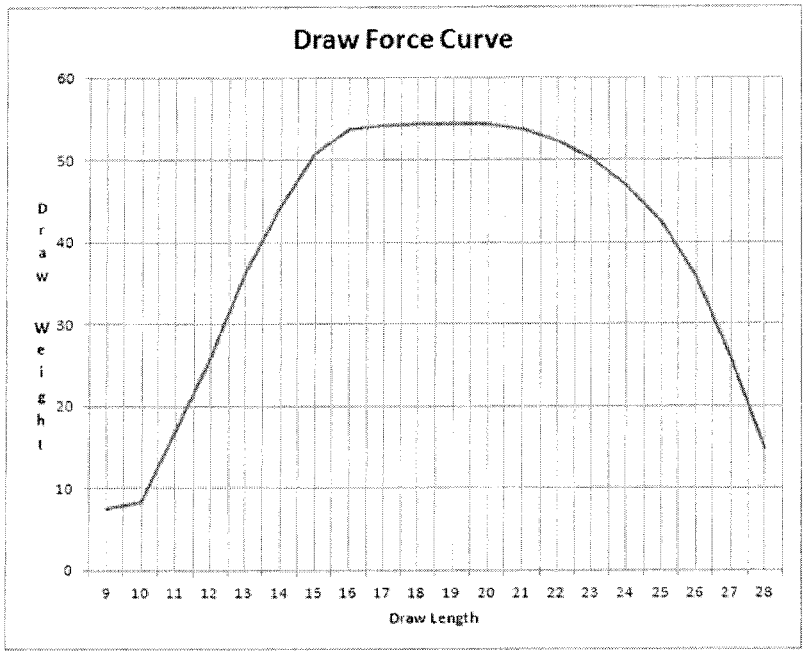
FIG. 14 is a combination of a draw length/weight chart with a graph showing a draw force curve by draw length.

The operation of the draw board 200 will be appreciated with a viewing of FIGS. 2 to 4 and 12 and 13. The compound bow 1 is positioned into the bow press 10 or similar anchoring system. The inside surface supports 78, 80 are secured over the bow limbs 3 adjacent the riser 2. The bow is now anchored. The crank 226 of the draw board 200 is turned to lower the scale 254 and hook 256 to be attached to the bow string 7 or loop 9 whichever is present. The scale is activated. The crank 226 is now turned oppositely to begin pulling on the bow string 7. The technician may watch and note the poundage on the scale 254 in relation to the gallows pole measurements at the draw length marker for charting and graphing as shown in FIG. 14.

With this information the archer knows exactly how much poundage he is pulling through each increment of the drawing of his bow. With time, arm and shoulder strength improves and the archer may which to increase the poundage of his bow, or in reverse, to decrease the poundage should the archer be recovering from an injury.

As the bow is drawn by the draw board to full draw, crank 226 is released and all remains static. The timing of the cabling coming off the pulley 4 and cam 5 can be checked. The technician next adjusts the pivot arm brackets 56, 58 to fit the limbs 3 of the bow 1. Then the bow press screw jack extension 113 is raised by crank 115 as to snug up the limb deflectors or ears 88, 96 to hold the limbs 3 in place. Then the draw board crank 226 may be turned as to lower the cord 238, scale 254 and hook 256. Further lowering of the hook will release the bow string. Thereafter, repair, tuning, and maintenance on the bow may be performed.

The foregoing description of the invention has been presented for purposes of illustration and description and is not intended to be exhaustive or limit the invention to the precise form disclosed. The intended scope of the invention is to be defined by the appended claims hereto and their equivalents.

What is claimed:

1. An archery bow draw board for an anchored compound archery bow having a riser, limbs, at least one cam with a pulley or two cams, a bow string with a cable, the draw board connectable to the bow string comprising:

a) a base plate supporting a gallows vertical pole and a gear box and side plate fixed therebelow;

b) a worm drive on a shaft within the gear box turnable by an outwardly extending crank handle;

c) an axel with a fixed reel and worm gear extending from the side plate into the gear housing wherein the worm gear meshes with the worm drive to drive the reel in either direction by turning the crank and hold the reel in place upon releasing the crank;

d) a gallows horizontal extension on top of the gallows pole with at least one pulley; and e) a cord wrapped around the reel and extending upwardly along the pole to the horizontal extension and over the pulley and then downwardly adapted to hook onto and pull the draw string.

2. The draw board of claim 1 further comprising, a second pulley on the gallows horizontal extension and in line with and spaced from the first pulley as to space the cord away from the gallows pole.

3. The draw board of claim 1 further comprising, a scale at the end of the cord downwardly from the pulley.

4. The draw board of claim 1 further comprising, numeric indicia on the gallows pole and a bow draw length marker coordinated on the cord as to indicate draw length of bow string pulled by the draw board.

5. The draw board of claim 1 further comprising, an archery bow press to which the draw board is attached.

6. The draw board of claim 1 further comprising, a cord pulley below the plate and above the reel as to guide the cord from the reel through a hole in the plate upwardly along the gallows pole.

7. An archery bow draw board for an anchored compound archery bow having a riser, limbs, at least one cam with a pulley or two cams, a bow string with a cable, the draw board connectable to the bow string comprising:

a) a base plate supporting a gallows vertical pole and a gear box and side plate fixed therebelow;

b) a worm drive on a shaft within the gear box turnable by an outwardly extending crank handle;

c) an axel with a fixed reel and worm gear extending from the side plate into the gear housing wherein the worm gear meshes with the worm drive to drive the reel in either direction by turning the crank and hold the reel in place upon releasing the crank;

d) a gallows horizontal extension on top of the gallows pole with a first pulley and a second pulley in line with and spaced from the first pulley away from the gallows pole;

e) a cord wrapped around the reel and extending upwardly along the pole to the horizontal extension and over the pulleys and then downwardly adapted to hook onto and pull the draw string; and f) numeric indicia on the gallows pole and a bow draw length marker coordinated on the cord as to indicate draw length of bow string pulled by the draw board.

8. The draw board of claim 7 further comprising, a scale at the end of the cord downwardly from the pulleys.

9. The draw board of claim 7 further comprising, an archery bow press to which the draw board is attached.

10. The draw board of claim 7 further comprising, a cord pulley below the plate and above the reel as to guide the cord from the reel through a hole in the plate upwardly along the gallows pole.

11. An archery bow draw board for an anchored compound archery bow having a riser, limbs, at least one cam with a pulley or two cams, a bow string with a cable, the draw board connectable to the bow string comprising:

a) a base plate supporting a gallows vertical pole and a gear box and side plate fixed therebelow;

b) a worm drive on a shaft within the gear box turnable by an outwardly extending crank handle;

c) an axel with a fixed reel and worm gear extending from the side plate into the gear housing wherein the worm gear meshes with the worm drive to drive the reel in either direction by turning the crank and hold the reel in place upon releasing the crank;

d) a gallows horizontal extension on top of the gallows pole with a first pulley and a second pulley in line with and spaced from the first pulley away from the gallows pole;

e) a cord wrapped around the reel and extending upwardly along the pole to the horizontal extension and over the pulley and then downwardly adapted to hook onto and pull the draw string;

f) numeric indicia on the gallows pole and a bow draw length marker coordinated on the cord as to indicate draw length of bow string pulled by the draw board; and g) a cord pulley below the plate and above the reel as to guide the cord from the reel through a hole in the plate upwardly along the gallows pole.

12. The draw board of claim 11 further comprising, a scale at the end of the cord downwardly from the pulleys.

13. The draw board of claim 11 further comprising, an archery bow press to which the draw board is attached.

* * * * *